US010930195B2

(12) United States Patent
Lin et al.

(10) Patent No.: US 10,930,195 B2
(45) Date of Patent: Feb. 23, 2021

(54) METHOD FOR DRIVING A DISPLAY PANEL TO DISPLAY IMAGE, DISPLAY APPARATUS THEREOF, AND DRIVER ENABLED TO PERFORM THE METHOD

(71) Applicant: BOE TECHNOLOGY GROUP CO., LTD., Beijing (CN)

(72) Inventors: Yicheng Lin, Beijing (CN); Mingi Chu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 340 days.

(21) Appl. No.: 15/776,989

(22) PCT Filed: Dec. 11, 2017

(86) PCT No.: PCT/CN2017/115442
§ 371 (c)(1),
(2) Date: May 17, 2018

(87) PCT Pub. No.: WO2018/223643
PCT Pub. Date: Dec. 13, 2018

(65) Prior Publication Data

US 2020/0327839 A1 Oct. 15, 2020

(30) Foreign Application Priority Data

Jun. 7, 2017 (CN) ..... 201710425265.X

(51) Int. Cl.
*G09G 3/32* (2016.01)
*G09G 3/20* (2006.01)
*G09G 3/3225* (2016.01)

(52) U.S. Cl.
CPC ..... *G09G 3/2003* (2013.01); *G09G 3/3225* (2013.01); *G09G 2300/0452* (2013.01); *G09G 2320/0233* (2013.01); *G09G 2360/16* (2013.01)

(58) Field of Classification Search
CPC ..... G02F 1/133611; G09G 3/2003; G09G 3/3208; G09G 3/3225; G09G 2300/0452;
(Continued)

(56) References Cited

U.S. PATENT DOCUMENTS

2006/0238943 A1* 10/2006 Awakura ..... G09G 3/3258 361/93.1
2006/0268378 A1* 11/2006 Yano ..... H04N 5/202 358/521

(Continued)

*Primary Examiner* — Michael J Eurice
(74) *Attorney, Agent, or Firm* — Intellectual Valley Law, P.C.

(57) ABSTRACT

The present application discloses a method for driving a display panel for displaying images. The method includes determining multiple subpixels in a bright area of an image to be displayed by the display panel. The bright area is an image display area having a luminance value maintained greater than a threshold luminance value for a duration longer than a threshold duration. Additionally, the method includes driving the multiple subpixels to emit light alternatingly in a period of alternate light-emission for displaying the image. Furthermore, the method includes driving all adjacent subpixels surrounding any one subpixel that is not emitting light during the period of alternate light-emission to provide luminance rendering to the one subpixel such that the luminance value of the bright area is greater than the threshold luminance value.

18 Claims, 5 Drawing Sheets

(58) Field of Classification Search
CPC ... G09G 2320/0233; G09G 2320/0257; G09G 2320/043; G09G 2320/046; G09G 2360/16; H01L 27/3213
See application file for complete search history.

(56) References Cited

U.S. PATENT DOCUMENTS

2007/0257944 A1* 11/2007 Miller ..... G09G 3/3225 345/694
2008/0117231 A1* 5/2008 Kimpe ..... G09G 3/20 345/629
2009/0051627 A1* 2/2009 Ihata ..... G09G 3/3208 345/76
2010/0085373 A1* 4/2010 Miyasaka ..... H04N 13/341 345/589
2010/0149204 A1* 6/2010 Han ..... G09G 5/02 345/589
2014/0098143 A1* 4/2014 Lee ..... G09G 3/2092 345/690
2014/0210878 A1* 7/2014 Broughton ..... G09G 3/003 345/694
2014/0232757 A1* 8/2014 Nakahata ..... G09G 3/2003 345/690
2014/0240293 A1* 8/2014 McCaughan ..... G06T 7/277 345/175
2015/0229898 A1* 8/2015 Rivard ..... H04N 5/2353 348/223.1
2016/0093255 A1* 3/2016 Aoki ..... G09G 3/3426 345/690
2017/0142312 A1* 5/2017 Dal Mutto ..... G06T 7/285
2017/0205652 A1* 7/2017 Zhou ..... G02F 1/13318
2018/0033380 A1* 2/2018 An ..... G06T 7/001
2018/0090075 A1* 3/2018 Garbacea ..... G09G 3/3291
2018/0188605 A1* 7/2018 Chu ..... G02F 1/133603
2018/0218690 A1* 8/2018 Zhou ..... G09G 3/3406
2018/0330695 A1* 11/2018 Baar ..... G09G 5/02
2019/0130844 A1* 5/2019 Yang ..... G09G 3/2007
2019/0353961 A1* 11/2019 Ji ..... G09G 3/3406
2019/0355316 A1* 11/2019 Ji ..... G09G 3/3426
2020/0175943 A1* 6/2020 Li ..... G09G 5/02
2020/0202798 A1* 6/2020 Kimbrell ..... G09G 3/3607
2020/0211480 A1* 7/2020 Xiang ..... G09G 3/3406

* cited by examiner

METHOD FOR DRIVING A DISPLAY PANEL TO DISPLAY IMAGE, DISPLAY APPARATUS THEREOF, AND DRIVER ENABLED TO PERFORM THE METHOD

CROSS-REFERENCE TO RELATED APPLICATION

This application is a national stage application under 35 U.S.C. § 371 of International Application No. PCT/CN2017/115442, filed Dec. 11, 2017, which claims priority to Chinese Patent Application No. 201710425265.X, filed Jun. 7, 2017, the contents of which are incorporated by reference in the entirety.

TECHNICAL FIELD

The present invention relates to display technology, more particularly, to a method for driving a display panel to display image, a display apparatus thereof, and a driver enabled to perform the method for driving the display panel to display images.

BACKGROUND

Active Matrix Organic Light Emitting Diode (AMOLED) display is a typical OLED display apparatus having many advantages in ultra-thin panel thickness, ultra-high contrast ratio, ultra-wide range color gamut, ultra-fast response rate, ultra-wide viewing angle, and ultra-large curvature deflection and has been widely applied in the field. AMOLED display includes a display panel. The display panel includes a base substrate and gate lines, data lines, and arrays of subpixels arranged on the base substrate. Each subpixel includes thin-film transistors (TFT), an anode, an organic light-emitting cell, a cathode, a connection between the gate of TFT to the gate line, a connection between the source of TFT to the data line, a connection between the drain of ET to the cathode. The display panel is operated to use a control signal to turn TFT on through the gate line and apply voltage signals sequentially through the source, the drain and the anode to the organic light-emitting cell to drive light-emission thereof for image display per subpixel. In other words, the subpixel is displaying a subpixel image by converting an electrical signal to an optical signal. By increasing the electrical signal applied to one subpixel, a luminance value of the subpixel can be raised to enhance image contrast ratio of the subpixel image relative to neighboring subpixel images.

Yet, maintaining a high luminance value of a subpixel for a long time will result in degradation of electro-optical conversion efficiency of the subpixel. If so, when a displayed image changes from one frame to another, the subpixel may fail to effectively convert the electrical signal to corresponding optical signal causing a decrease of luminance value of the subpixel and the display panel to display a residual image distorted from an original one.

SUMMARY

In an aspect, the present disclosure provides a method for driving a display panel to display image. The method includes determining multiple subpixels in a bright area of an image to be displayed by the display panel. The bright area is an image display area having a luminance value maintained greater than a threshold luminance value for a duration longer than a threshold duration. The method further includes driving the multiple subpixels to emit light alternatingly in a period of alternate light-emission for displaying the image. Additionally, the method includes driving at least one adjacent subpixel surrounding a first subpixel that is not emitting light during the period of alternate light-emission to provide luminance rendering to the first subpixel such that the luminance value of the bright area is greater than the threshold luminance value.

Optionally, the method of driving the multiple subpixels to emit light alternatingly in the period of alternate light-emission includes determining the first subpixel and second subpixels among the multiple subpixels in the bright area corresponding to each period of alternate light-emission. The second subpixels are adjacent subpixels surrounding the first subpixel. The method of driving the multiple subpixels further includes controlling the first subpixel to not emit light and the second subpixels to emit light with luminance values being increased for providing the luminance rendering to the first subpixel during each period of alternate limit-emission.

Optionally, the method of providing the luminance rendering to the first subpixel includes determining an original luminance value of the first subpixel. The original luminance value of the first subpixel is a luminance value when the first subpixel is controlled to emit light according to an original image display data. The method of providing the luminance rendering to the first subpixel further includes controlling the second subpixel to emit light and adjusting luminance values of the second subpixels based on the original luminance value of the first subpixel, wherein the luminance values of the second subpixels are increased to provide the luminance rendering to the first subpixel when the first subpixel is not emitting light. A luminance value of the first subpixel after the luminance rendering substantially equals to the original luminance value.

Optionally, the method of adjusting the luminance values of the second subpixels based on the original luminance value of the first subpixel includes calculating a target luminance value of each second subpixel using a subpixel rendering algorithm based on the original luminance value of the first subpixel and adjusting the luminance value of the each second subpixel based on the target luminance value.

Optionally, in any one period, of alternate light-emission, at least two second subpixels are driven to emit light and two subsequent periods of alternate light-emission are not associated with any second subpixel in common.

Optionally, the multiple subpixels constitute an array of repeating units. Each of the repeating units includes at least two of the multiple subpixels. Each of the repeating units is associated with at least one period of alternate light-emission. At least two periods of alternate light-emission are associated with different subpixels of the multiple subpixels in one of the repeating units.

Optionally, the first subpixels in the bright area in at least two periods of alternate light-emission are capable of emitting light of a same color.

Optionally, at least two first subpixels in the bright area are controlled not to emit light in each period of alternate light-emission.

Optionally, the display panel includes a plurality of subpixels being arranged in SPR form.

Optionally, the plurality of subpixels is arranged in an order based on color of emitted light thereof. The order includes a repeating unit of four sequential subpixels capable of emitting red-color, green-color, blue-color, and green-color in a row adapted to a subpixel rendering operation.

In another aspect, the present disclosure provides a driver for controlling image display operation of a display panel comprising at least a processor including a computer readable storage media. The computer readable storage media is configured to store computer-executable instructions. The processor is configured to execute the computer-executable instructions for controlling a display panel for displaying images. The computer-executable instructions include a first set of instructions for determining multiple subpixels in a bright area of an image to be displayed by the display panel. The bright area is an image display area having a luminance value maintained greater than a threshold luminance value for a duration longer than a threshold duration. The computer-executable instructions also include a second set of instructions for driving the multiple subpixels to emit light alternatingly in a period of alternate light-emission for displaying the image and driving at least one adjacent subpixel surrounding a first subpixel that is not emitting light during the period of alternate light-emission to provide luminance rendering to the first subpixel such that the luminance value of the bright area is greater than the threshold luminance value.

Optionally, the second set of instructions includes a first subset of instructions for determining the first subpixel and second subpixels among the multiple subpixels in the bright area corresponding to each period of alternate light-emission. The second subpixels are several adjacent subpixels surrounding the first subpixel. The second set of instructions also includes a second subset of instructions for controlling the first subpixel to not emit light and the second subpixels to emit light in each period of alternate light-emission so that luminance values of the second subpixels are increased to provide the luminance rendering to the first subpixel without emitting light.

Optionally, the second subset of instructions includes a first sub-subset of instructions for determining an original luminance value of the first subpixel. The original luminance value of the first subpixel is a luminance value when the first subpixel is controlled to emit light according to an original image display data. The second subset of instructions further includes a second sub-subset of instructions for controlling the second subpixels to emit light. The second subset of instructions additionally includes a third sub-subset of instructions for adjusting luminance values of the second subpixels based on the original luminance value of the first subpixel. The luminance values of the second subpixels are increased to provide the luminance rendering to the first subpixel when the first subpixel is not emitting light. A luminance value of the first subpixel after the luminance rendering substantially equals to the original luminance value.

Optionally, the third sub-subset of instructions includes an instruction for calculating a target luminance value of each second subpixel using a subpixel rendering algorithm based on the original luminance value of the first subpixel and adjusting the luminance value of the each second subpixel based on the target luminance value.

Optionally, in any one period of alternate light-emission, at least two second subpixels are driven to emit light alternatingly and two adjacent periods of alternate light-emission are not associated with any second subpixel in common.

Optionally, the multiple subpixels constitute an array of pixels. Each of which the array of pixels includes at least two of the multiple subpixels. Each of the array of pixels corresponds to at least one period of alternate light-emission. At least two periods of alternate light-emission correspond to different subpixels of the multiple subpixels in the each of the array of pixels.

Optionally, the first subpixels in the bright area in at least two periods of alternate light-emission are capable of emitting light of a same color.

Optionally, at least two first subpixels in the bright area are controlled not to emit light in each period of alternate light-emission.

Optionally, the display panel includes a plurality of subpixels being arranged in an order based on color of emitted light thereof. The order including a repeating unit of four sequential subpixels capable of emitting red-color, green-color, blue-color, and green-color in a row adapted to a subpixel rendering operation.

In another aspect, the present disclosure provides a display apparatus comprising a display panel and a driver described herein including a processor having a computer readable storage media to store computer-executable instructions and to execute the computer-executable instructions for driving the display panel to display images.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

TV based on AMOLED display has been gradually implemented and has huge potential for future market success. Due to limitation of AMOLED device function, however, after displaying a static image with respective subpixels being maintained to a certain luminance values for a long time when the display panel changes to a next frame of image, the display panel is susceptible to displaying a residual image of the previous static image.

To solve the issue of residual image of the AMOLED display panel, an image processing technique using Subpixel Rendering (SPR) treatment is used in the present disclosure, in which an algorithm of performing the subpixel rendering based on array of subpixels arranged on the display panel in a special SPR arrangement is disclosed. Accordingly, the present disclosure provides, inter alia, a method of controlling image display of a display panel, a driver for implementing the method, and a display apparatus having the same that substantially obviate one or more of the problems due to limitations and disadvantages of the related art.

Figure 1:
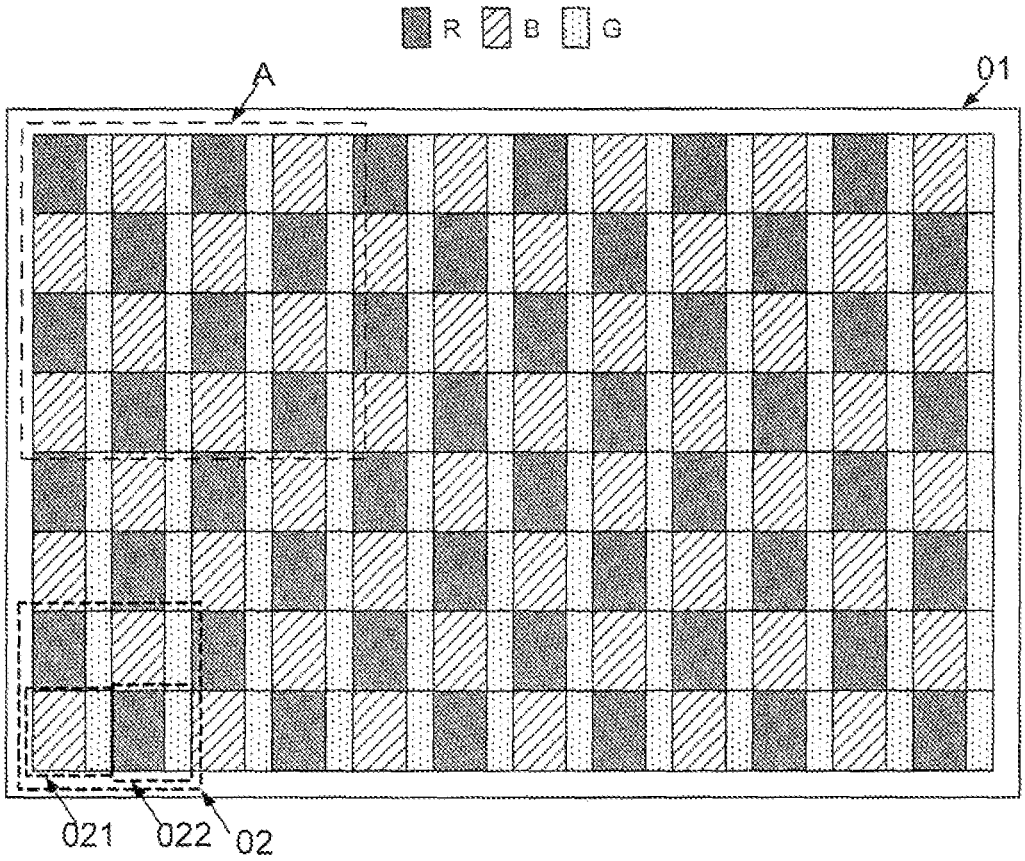
FIG. 1 is a schematic diagram of a display panel according to some embodiments of the present disclosure.

In one aspect, the present disclosure provides a display panel having a plurality of subpixels arranged in a special arrangement adapted to subpixel rendering operation. FIG. 1 is a schematic diagram of a display panel according to some embodiments of the present disclosure. Referring to FIG. 1, the display panel includes a base substrate 01 and a plurality of subpixels formed on the base substrate. The plurality of subpixels includes red subpixel (R), green subpixel (G), and blue subpixel (B). In particular, the plurality of subpixels is arranged in a SPR arrangement with an order of RGBG as a repeating unit in each row of the different colored subpixels.

In an embodiment, multiple subpixels arranged in a SPR arrangement with an order of RGBG form multiple repeating units 02. Referring to FIG. 1, each repeating unit 02 of the embodiment includes four pixels, each of Which includes two subpixels with different colors. The four pixels are in two adjacent rows of subpixels and any two adjacent pixels are not in common. For example, one pixel 021 includes a blue subpixel B and a green subpixel G. An adjacent pixel 022 in the same row includes a red subpixel R and a green subpixel G. An adjacent pixel in the same column of the pixel 021 and adjacent to the pixel 021 is another pixel 022. An adjacent pixel in the same column of the pixel 022 and adjacent to the pixel 022 is another pixel 021. Each of all adjacent pixels of the pixel 021 is a pixel 022. Each of all adjacent pixels of the pixel 022 is a pixel 021.

Optionally, the array of subpixels can be arranged in other SPR arrangement with different orders. Different arrangement orders of R, G, B colored subpixels should not alter the nature of claims of the present disclosure.

Figure 2A:
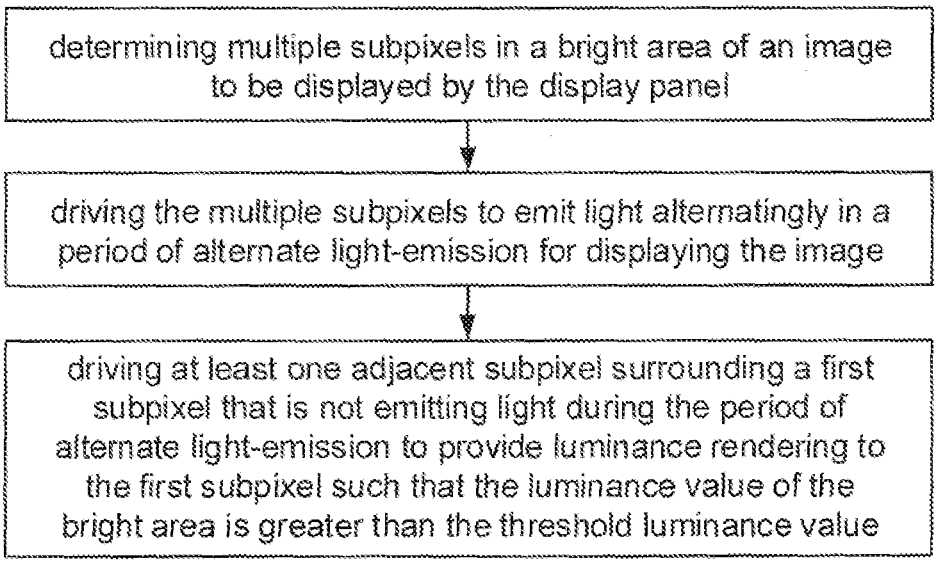
FIG. 2A is a flow chart showing a method of driving a display panel to display image according to an embodiment of the present disclosure.

In an aspect, the present disclosure provides a method for driving a display panel having a plurality of subpixels arranged with a certain SPR arrangement to display image. FIG. 2A shows a flow chart of the method of driving the display panel of FIG. 1 to display an image. The method includes determining multiple subpixels in a bright area of an image to be displayed by the display panel. The bright area is an image display area having a luminance value maintained greater than a threshold luminance value for a duration longer than a threshold duration.

Optionally, the threshold luminance value can be set according to particular display panel at particular situation of image display. For example, the threshold luminance value can be set based on a luminance value of the whole image to he displayed. The threshold luminance value usually is greater than the luminance value of the whole image to be displayed. Then the bright area can be a portion of the whole image to be displayed that has a high luminance value.

Optionally, the threshold duration can be set according to specific situation of image display and used to determine if an image to be displayed is a static image. For example, when a duration of maintaining a luminance value for an image to be displayed is longer than the threshold duration, the image to be displayed is considered as a static image. When the duration of maintaining luminance value for an image to be displayed is shorter than or equal to the threshold duration, the image to be displayed is considered to be a dynamic image.

In the embodiment, the image to be displayed is going to be displayed through the subpixels arranged in SPR arrangement on the display panel. In particular, the image is displayed by using a driver associated with the display panel to drive subpixels to emit light. The driver includes a driving circuit controlled and operated by a controller using a plurality of sets of computer-executable instructions stored in a memory device. Each subpixel includes a thin-film transistor (TFT), an anode, an organic light-emitting cell, a cathode, a connection between the gate of TFT to the gate line, the source of TFT being electrically connected to the data line, the drain of TFT being electrically connected to the cathode. The driving circuit of the driver is connected to the gate line and the data line associated with each subpixel. In particular, the driver is configured to control on or off of the TFT through the gate line and gate electrode of the TFT to turn the subpixel on or off. When the subpixel is turned on, the diver is configured to apply a driving voltage through the data line to the subpixel to drive organic light-emitting cell to emit light for displaying a subpixel image. A value of the driving voltage is used to determine a luminance value of the subpixel. In a condition without considering electro-optical conversion efficiency of the subpixel, the driving voltage is proportional to the luminance value of the subpixel.

Optionally, the driver is configured to determine a respective value of the driving voltage to be applied to each subpixel before driving the display panel to display an image. Based on the value of the driving voltage, the driver determines the corresponding luminance value of each subpixel. Additionally, the driver is configured to determine a respective length of duration of applying the driving voltage to each subpixel. The driver then is able to determine an image display area to be a bright area if all subpixels in the display area have luminance values greater than a threshold luminance value and the duration for applying the driving voltage to the corresponding subpixels longer than a threshold duration. Or, the driver is configured to determine a value of each driving voltage to be applied to each subpixel before the to-be-displayed image is displayed by the display panel, based on which the driver calculates different luminance values that need to maintain at different image display areas and determines a target display area where the luminance values to be maintained are larger than the threshold luminance. Further, the driver is configured to determine different durations of maintaining certain luminance values in the different target display areas based on different durations of applying respective driving voltages to respective subpixels in the different target display areas. Furthermore, the driver is able to determine an image display area to be a bright area if a duration of maintaining a luminance value greater than a threshold luminance value in the image display area among the different target display areas is longer than a threshold duration. Optionally, the bright area of an image displayed on the display panel can be determined alternatively using different methods.

In the embodiment, after determining the bright area, multiple subpixels associated with the bright area can be determined. Referring to FIG. 1, an image display area A is marked, including four repeating units 02, each of which includes four pixels and each pixel includes two subpixels. Thus, the image display area A includes 4×4 pixels, e.g., four pixels in a row and four pixels in a column, corresponding to multiple subpixels as shown.

Referring to FIG. 2A, the method of driving the display panel to display an image further includes controlling multiple subpixels in the bright area to alternatingly emit light and drive several subpixels that are emitting light surrounded a subpixel that is not emitting light to perform a luminance rendering operation such that the luminance value of the bright area is greater than the threshold luminance. The luminance value of each subpixel after rendering operation is the brightness of the subpixel on the display panel viewed in viewer's eyes. By controlling subpixels to alternatingly emit light, the degradation of electro-optical conversion efficiency of each individual subpixel due to long-time emission can be substantially avoided. The luminance rendering operation applied to a subpixel that is turned off by several adjacent subpixels surrounded it imposes a blurring effect to the subpixel not emitting light, substantially maintaining quality of the image displayed without being affected by this dark subpixel.

Figure 2B:
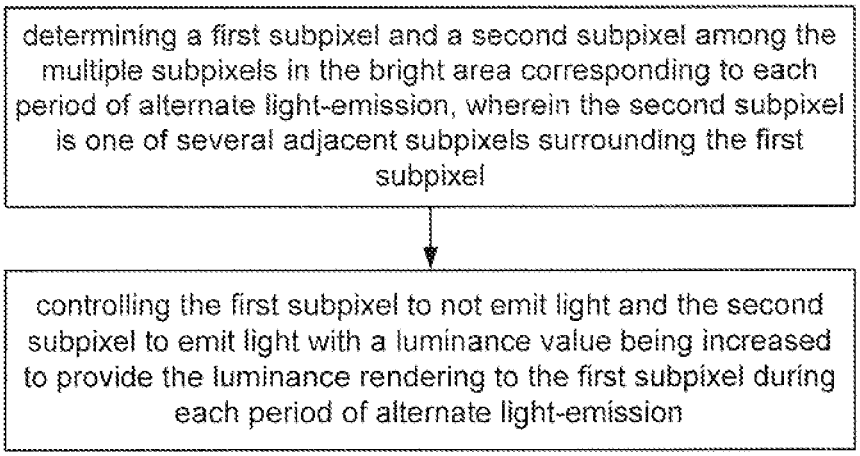
FIG. 2B is a flow chart showing a method of driving multiple subpixels to emit light alternatingly according to the embodiment of the present disclosure.

FIG. 2B is a flow chart showing a method of driving multiple subpixels to emit light alternatingly according to the embodiment of the present disclosure. Referring to FIG. 2B, the method includes determining a first subpixel and second subpixels among multiple subpixels in the bright area in association with each period of alternate light-emission. The second subpixels include several adjacent subpixels surrounding the first subpixel.

In the embodiment, the driver associated With the display panel is configured to drive multiple subpixels in the bright area to alternatingly emit light. Optionally, the driver drives the multiple subpixels associated with the bright area to emit light periodically. In other words, a duration of one or more first subpixels of the multiple subpixels being driven to not emit light is a period of alternate light-emission. In each period of alternate light-emission, at least one subpixel is controlled to not emit light while other subpixels in the bright area are controlled to emit light. Optionally, in each period of alternate light-emission, at least two first subpixels are controlled to not emit light while other subpixels in the bright area are controlled to emit light. The length of the period of alternate light-emission is determined based on pixel electro-optical conversion function. Optionally, the period of alternate light-emission is set to 1 second or others.

In the embodiment, the driver is configured to randomly determine a first subpixel to not emit light among the multiple subpixels in each period of alternate light-emission. Optionally, the driver can be configured to determine the first subpixel based on a particular selection rule but not limited thereof For each period of alternate light-emission, all second subpixels as the adjacent subpixels surrounding the first subpixel can be determined once the first subpixel is determined.

Optionally, the multiple subpixels associated with the bright area are arranged to an array of multiple repeating units, each of which includes at least two subpixels. For two consecutive periods of alternate light-emission, the two respective first subpixels may or may not be in respective two adjacent repeating units. Yet, each repeating unit is associated with at least one period of alternate light-emission. When a repeating unit is associated with two periods of alternate light-emission, one earlier and one later, the two periods of alternate light-emission are associated with different subpixels in the repeating unit. In the embodiment, each period of alternate light-emission is associated with at least two second subpixels. Any two subsequent periods of alternate light-emission are not associated with a second subpixel in common. Any two periods of alternate light-emission are associated with respective two first subpixels with either a same color or different color. In any period of alternate light-emission, the bright area includes at least two first subpixels being controlled to not emit light.

Figure 3:
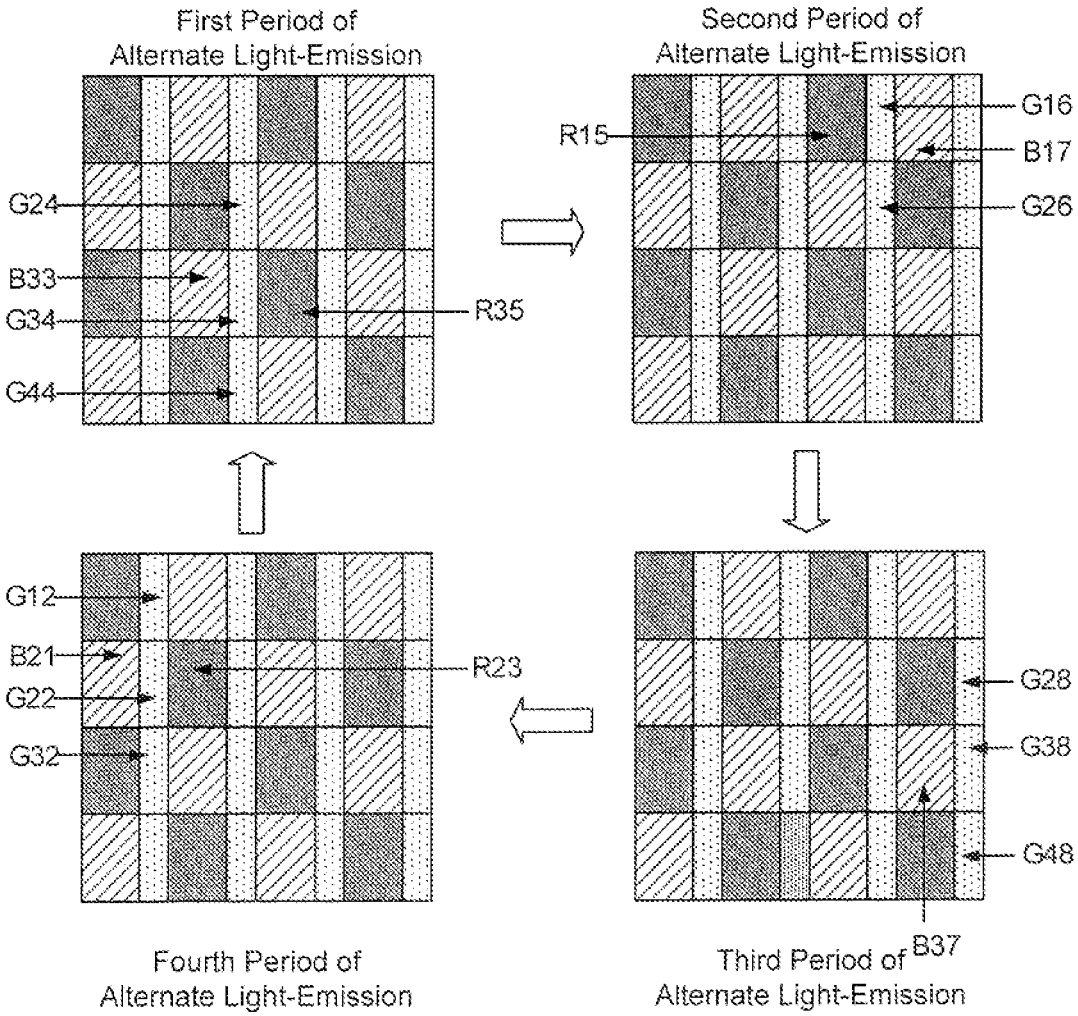
FIG. 3 is a schematic diagram showing a first subpixel and several second subpixels associated with each period of alternate light-emission according to the embodiment of the present disclosure.

Referring to FIG. 1, in an example, the bright area includes an image display area A which contains multiple subpixels arranged in four repeating units. Each repeating unit includes 4 pixels. Each pixel includes two subpixels, one of them is a red pixel R and a green subpixel G and another is a blue subpixel B and a green subpixel G. FIG. 3 is a schematic diagram showing a first subpixel and several second subpixels associated with each period of alternate light-emission according to the embodiment of the present disclosure. Referring to FIG. 3, four consecutive periods of alternating light-emission are used to illustrate the selection of a first subpixel and corresponding several second subpixels in each period. For example, in the first period of alternate light-emission, a first subpixel is subpixel G34 and the second subpixels include subpixel G24, subpixel B33, subpixel R35, and subpixel G44. In the second period of alternate light-emission, subpixel G16 is selected to be the first subpixel. Accordingly, the second subpixels include subpixel R15. subpixel B17, and subpixel G26. In the third period of alternate light-emission, subpixel G38 is selected to be the first subpixel. Accordingly, the second subpixels surrounding the first subpixel include subpixel G28, subpixel B37, and subpixel G48. In the fourth period of alternate light-emission, subpixel G22 is the first subpixel. Accordingly, the second subpixels include subpixel G12, subpixel B21, subpixel R23, and subpixel G32. Here, an arbitrary subpixel is denoted as Pab. P is one of R, G, and B, respectively for denoting red subpixel, green subpixel, and blue subpixel. a represents a row coordinate of the subpixel P and b represents a column coordinate of the subpixel P. For example, subpixel G34 is a green subpixel G in third row and fourth column. Subpixel R35 is a red subpixel R in third row and fifth column. Subpixel B21 is a blue subpixel B in second row and first column.

Optionally, in two consecutive periods of alternate light-emission, the first subpixel can be located in two adjacent repeating units (of subpixels) or non-adjacent repeating units. Optionally, each repeating unit in the bright area is associated with at least one period of alternate light-emission. Optionally, each repeating unit in the bright area is associated with at least two periods of alternate light-emission and the two periods of alternate light-emission are associated with different subpixels in the each repeating unit. For example, referring to FIG. 3, each repeating unit is associated with one period of alternate light-emission. Optionally, each period of alternate light-emission is associated with at least two second subpixels. Any two subsequent periods of alternate light-emission are associated with several second subpixels not in common. For example, in the first period of alternate light-emission, four second subpixels associated with the first period are subpixel G24, subpixel B33, subpixel R35, and subpixel G44. Then, in the second period of alternate light-emission that is occurred subsequent to the first period of alternate light-emission, three second subpixels are subpixel R15, subpixel B17, and subpixel G26, none of them is in common with any one of four second subpixels in the first period.

Optionally, any two periods of alternate light-emission are respectively associated with two first subpixels capable of emitting a same color or different colors. Optionally, each period of alternate light-emission is associated with at least two first subpixels in the bright area.

Referring back to FIG. 2B, the method of driving multiple subpixels to emit light alternatingly also includes controlling the first subpixel to not emit light and the second subpixels to emit light with a luminance value being increased to provide the luminance rendering to the first subpixel during each period of alternate light-emission.

In the embodiment, the driver is configured, in every period of alternate light-emission after determining at least a corresponding first subpixel and several second subpixels, to control turning off the corresponding first subpixel to not emit light and turning on the corresponding second subpixels to emit light and to control increasing luminance values of the second subpixels to provide luminance rendering to the first subpixel to make the luminance value of the bright area to be greater than a threshold luminance.

Figure 4:
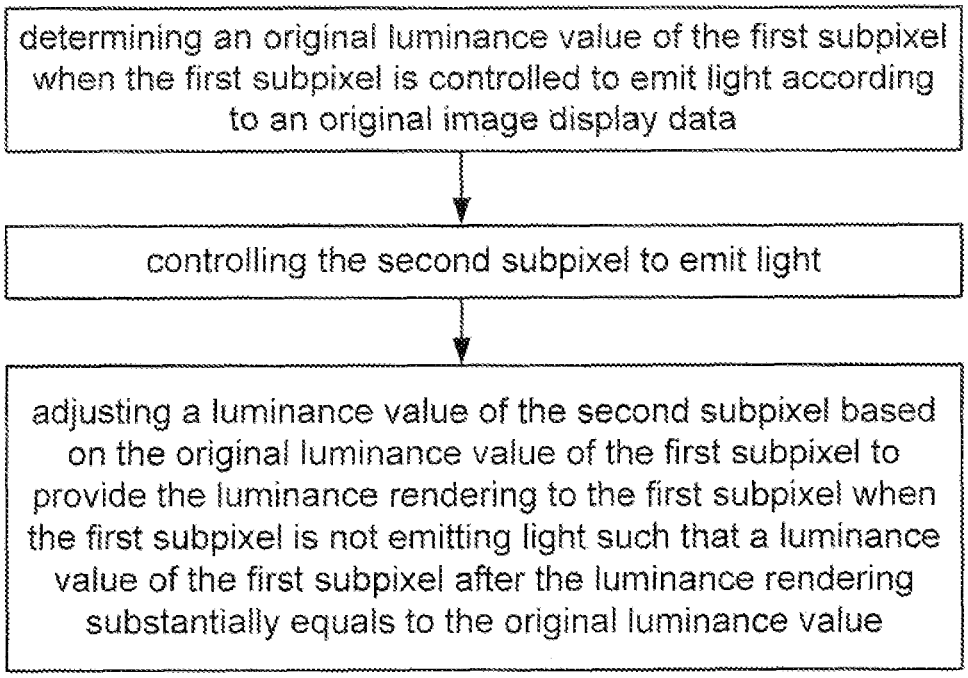
FIG. 4 is a flow chart showing a method of controlling the second subpixels to perform luminance rendering to the first subpixel according to the embodiment of the present disclosure.

FIG. 4 is a flow chart showing a method of controlling the second subpixels to perform luminance rendering to the first subpixel according to the embodiment of the present disclosure. In particular, the method includes determining an original luminance value of the first subpixel which is a luminance value when the first subpixel is controlled to emit light according to an original image display data. The original luminance value is just a luminance value of emitted light by the first subpixel based on a normal driving voltage applied thereof from the driver of the display panel before the driver to decide to turn off the first subpixel. Optionally, the original luminance value is stored in a memory device of the driver associated with the display panel and can be retrieved for using in luminance rendering operation.

Figure 5:
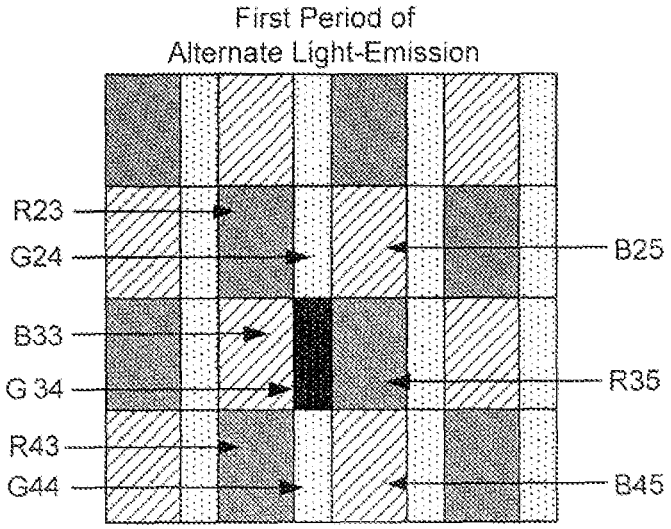
FIG. 5 is a schematic diagram showing a first subpixel being shut off according to the embodiment of the present disclosure.

FIG. 5 is a schematic diagram showing a first subpixel being shut off according to the embodiment of the present disclosure. Referring to FIG. 5, the driver associated with the display panel is configured to control the first subpixel G34 to be turned off in a period. The subpixel G34, in the period, no longer emits light and appears dark shown as a black color. Optionally, the driver is configured to operate a driving circuit connected to the gate electrode of the thin-film transistor (TFT) in the first subpixel G34 through at least the gate line to send a control voltage signal to shut off the TFT (or send no voltage to automatically turn off the TFT) to make it not to emit light in the period.

Referring to FIG. 4, the method further includes controlling the second subpixels to emit light. Optionally, the driver is configured to operate the driving circuit connected to the gate electrode of the TFT in each corresponding second subpixel to send a voltage signal to turn of the TFT to allow light to emit thereof. Referring to FIG. 5, the driver controls to turn on the second subpixels surrounding the first subpixel G34 including the nearest neighboring subpixels G24, B33, R35, and G44. Optionally, the second subpixels being turned on in the method for rendering operation also include the second nearest neighboring subpixels of the first sub pixel G34 including R23, B25, R43, and B45.

Further, the method includes adjusting luminance values of the second subpixels based on the original luminance value of the first subpixel. In particular the luminance values of the second subpixels are increased to provide the luminance rendering to the first subpixel when the first subpixel is not emitting light such that a luminance value of the first subpixel after the luminance rendering substantially equals to the original luminance value. In other words, a viewer simply cannot tell difference of the luminance value of the first subpixel in the displayed image before and after the luminance rendering.

Figure 6:
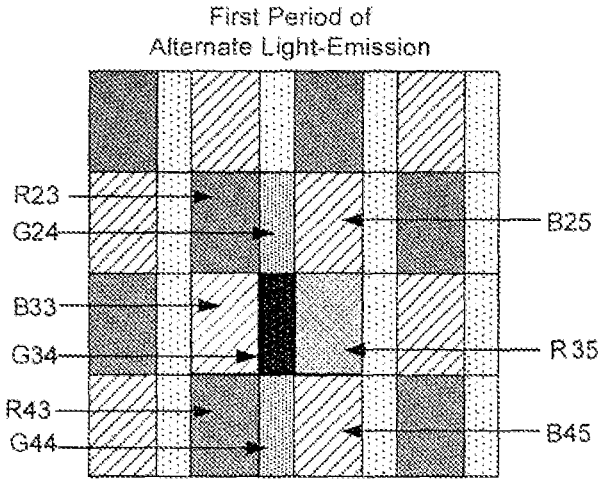
FIG. 6 is a schematic diagram showing second subpixels being controlled to perform luminance rendering to the first subpixel according to the embodiment of the present disclosure.

In the embodiment, the multiple subpixels in the bright area are arranged in one of SPR orders. The driver associated with the display panel is configured to adjust luminance values of the second subpixels based on the original luminance value of the first subpixel stored in the memory device. In particular, the driver uses a Subpixel Rendering algorithm depended on the subpixel arrangement in one of SPR orders to calculate a luminance value of each second subpixel, based on which the luminance value of each second subpixel is adjusted. Optionally, after a luminance value is calculated for a second subpixel, the driver is able to determine a driving voltage corresponding to the calculated luminance value and to operate the driving circuit to apply the driving voltage through a data line connected to the second subpixel so that the second subpixel is able to emit light with the corresponding luminance value to achieve adjusting a luminance value of a second subpixel. The same method is applicable to adjusting luminance value of each other second subpixel. Each second subpixel may have different adjusted luminance value. FIG. 6 shows an example that the second subpixels are controlled to adjust luminance values to provide luminance rendering to the first subpixel according to the embodiment of the present disclosure. In FIG. 6, the first subpixel G34 has an original luminance value L34 and now is shut off. The driver uses the SFR algorithm to calculate luminance values of the second subpixels including the nearest neighboring subpixels G24, B33, R35, and G44 respectively to be L24, L33, L35, and L44 based on the original luminance value L34 of the first subpixel G34. Based on these calculated luminance values, the driver then determines respective driving voltages of V24, V23, V35, and V44 corresponding to the second subpixels G24, B33, R35, and G44. Optionally, the SPR algorithm used by the driver also is configured to calculate luminance values of the second nearest neighboring subpixels including R23, B25, R43, and B45 to obtain their respective adjust luminance value L23, L25, L43, and L45 based on the original luminance value L34 of the first subpixel G34. By operating the driving circuit to apply the driving voltages through respective data lines to TFTs in those second subpixels, the corresponding luminance values thereof are adjusted.

Figure 7:
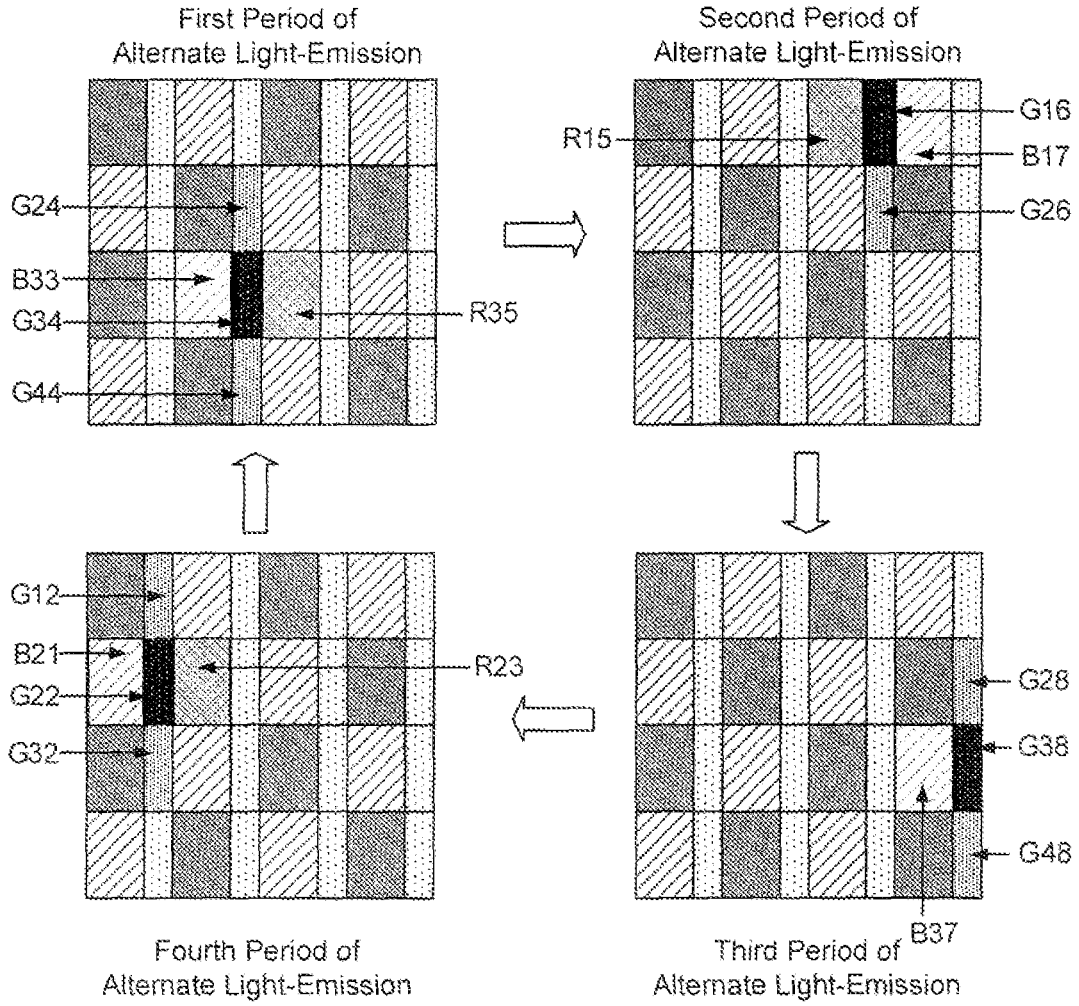
FIG. 7 is a schematic diagram showing multiple subpixels being, driven to emit light alternatingly according to the embodiment of the present disclosure.

Optionally, in each period of alternate light-emission a corresponding first subpixel is controller to shut off, and all second subpixels are controlled to emit light with increasing luminance values to provide luminance rendering to the first subpixel. FIG. 7 is a schematic diagram showing multiple subpixels being driven to emit light alternatingly according to the embodiment of the present disclosure. Referring to FIG. 7, in the first period of alternate light-emission, the driver controls the first subpixel G34 to be off and controls the second subpixels G24, B33, R35, G44 to emit light respectively with an increased luminance value. For simplifying description, only the nearest neighboring subpixels are considered to be included in the second subpixels. More fine controls can be achieved by including those second nearest neighboring subpixels as the second subpixels in the operation. Optionally, a number of second subpixels that are included in the luminance rendering operation can be one. Optionally, a number of second subpixels that are included in the luminance rendering operation can be multiple including nearest neighbors or next nearest neighbors of the first subpixel. In the second period of alternate light-emission, the driver controls the first subpixel G16 to be off and controls the second subpixels R15, B17, and G26 to emit light respectively with an increased luminance value. In the third period of alternate light-emission, the driver controls the first subpixel G38 to be off and the second subpixels G28, B37, and G48 to emit light respectively with an increased luminance value. In the fourth period of alternate light-emission, the driver controls the first subpixel G22 to be off and the second subpixels G12, B21, R23, and G32 to emit light respectively with an increased luminance value. Of course, after the fourth period of alternate light-emission, the driver is able to drive multiple other subpixels in the bright area to emit (or not emit) light alternatingly in similar manner shown above. All these periods of alternate light-emission are a duration of displaying a static image. This method of driving the display panel to display image is able to avoid to keep a single subpixel to emit light for a long time (in the duration of displaying the static image) so as to prevent the residue image effect when the current frame of image is changed to a new frame of different image. Additionally, the luminance rendering operation provided in the method ensures that the luminance value in the bright area remains to be substantially the same to maintain good quality of the image displayed. Note: in the description above, although green subpixel G of FIG. 7 is selected as the first subpixel to be shut off before performing luminance rendering, other subpixels like blue subpixel B or red subpixel R can be similarly selected to be the first subpixel to be shut off and corresponding luminance values of adjacent second subpixels are controlled to be increased to provide luminance rendering to the first subpixel.

Figure 8:
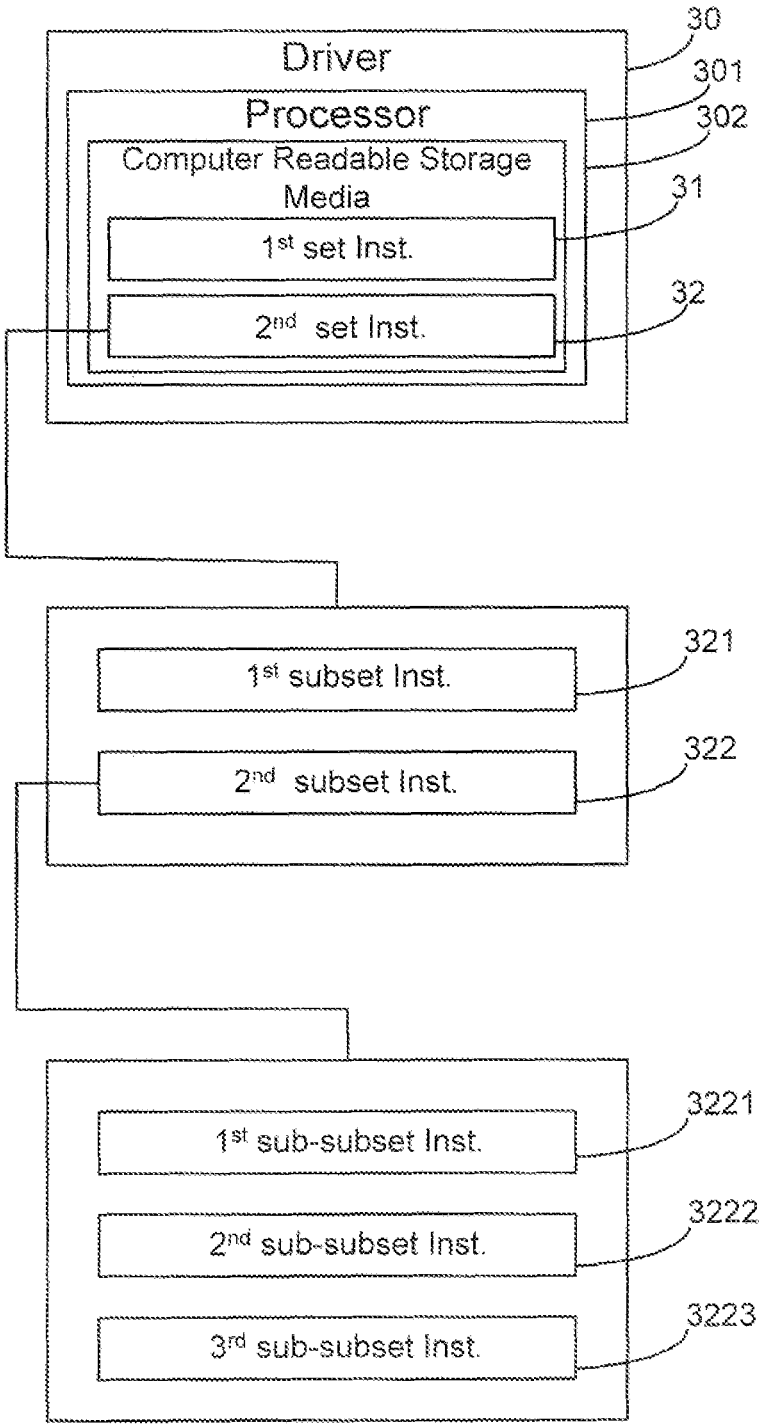
FIG. 8 is a block diagram showing a driver constructed to control operation of a display panel according to some embodiments of the present disclosure.

In another aspect, the present disclosure provides a driver for controlling image display operation of a display panel. Referring to FIG. 8, in some embodiments the driver 30 includes at least a processor 301 which includes a computer readable storage media 302. The computer readable storage media 302 is configured to store computer-executable instructions. The processor 301 is configured to execute the computer-executable instructions for controlling a display panel for displaying images. Optionally, the driver 30 is coupled to a driving circuit (not shown) and the processor 301 is configured to provide one or more control signals based on the computer-executable instructions to the driving circuit to perform one or more circuit operations. Optionally, the one or more circuit operations include sending a control voltage through a gate line for controlling on or off of a TFT in a subpixel or send a driving voltage through a data line to the subpixel to allow light emission at a certain luminance value.

Referring to FIG. 8 again, the computer-executable instructions stored in the computer readable storage media 302 include a first set of instructions 31 for determining multiple subpixels in a bright area of an image to be displayed by the display panel. Here the bright area is an image display area having a luminance value maintained greater than a threshold luminance value for a duration longer than a threshold duration. Additionally, the computer readable storage media 302 include a second set of instructions 32 for driving the multiple subpixels to emit light alternatingly in a period of alternate light-emission for displaying the image and driving all adjacent subpixels surrounding any one subpixel that is not emitting light during the period of alternate light-emission to provide luminance rendering to the one subpixel such that the luminance value of the bright area is greater than the threshold luminance value.

Further, referring to FIG. 8, the second set of instructions 32 includes a first sub-subset of instructions 321 for determining a first subpixel and second subpixels among the multiple subpixels in the bright area corresponding to each period of alternate light-emission. The second subpixels are several adjacent subpixels surrounding the first subpixel. The second set of instructions 32 further includes a second subset of instructions 322 for controlling the first subpixel to not emit light and the second subpixels to emit light in each period of alternate light-emission so that luminance values of the second subpixels are increased to provide the luminance rendering to the first subpixel without emitting light.

Additionally, referring to FIG. 8, the second subset of instructions 322 includes a first sub-subset of instructions 3221 for determining an original luminance value of the first subpixel. Here the original luminance value of the first subpixel is a luminance value when the first subpixel is controlled to emit light according to an original image display data. Additionally, the second subset of instructions 322 includes a second sub-subset of instructions 3222 for controlling the second subpixels to emit light. Moreover, the second subset of instructions 322 includes a third sub-subset of instructions 3223 for adjusting luminance values of the second subpixels based on the original luminance value of the first subpixel. In particularly, the luminance values of the second subpixels are increased to provide the luminance rendering to the first subpixel when the first subpixel is not emitting light such that a luminance value of the first subpixel after the luminance rendering substantially equals to the original luminance value.

Optionally, the multiple subpixels in the bright area are arranged in a certain SPR order adapted for subpixel rendering operation. The processor 301, in order to execute the third sub-subset of instructions 3223 for adjusting luminance values of the second subpixels based on the original luminance value of the first subpixel, is to execute a first instruction for calculating a luminance value of each second subpixel using a SPR algorithm depended on the SPR order arrangement of the multiple subpixels. Then the processor 301 sends a control signal for controlling adjustment of the luminance value of the second subpixel based on the calculated luminance value. Optionally, any period of alternate light-emission is associated with at least two second subpixels for providing luminance rendering to the first subpixel. Optionally, any two consecutive periods of alternate light-emission are not associated with any second subpixel in common. Optionally, the multiple subpixels are arranged with multiple repeating units, each of which includes at least two subpixels. Optionally, any two consecutive periods of alternate light-emission are associated with respective two first subpixels located in two repeating units that are either adjacent to each other or not. Optionally, each repeating unit of the multiple subpixels is associated with at least one period of alternate light-emission. Optionally, each repeating unit of the multiple subpixels is associated with at least two periods of alternate light-emission, one earlier than another. The two periods of alternate light-emission are associated with different subpixels in each repeating unit. Optionally, any two periods of alternate light-emission are associated with respective two first subpixels capable of emitting a same color. Optionally, in each period of alternate light-emission at least two first subpixels are selected to not emit light in the bright area.

In another aspect, the present disclosure provides a display apparatus including a display panel and a driver described herein including a processor having a computer readable storage media to store computer-executable instructions and to execute the computer-executable instructions for driving the display panel to display images. The display panel is an OLED display panel. Optionally, the OLED display panel is an AMOLED display panel.

In an alternative aspect, the present disclosure provides a control terminal including a processor, a memory configured to store instructions executable by the processor. The processor is configured to determine multiple subpixels in a bright area of an image to be displayed by the display panel. Here the bright area is an image display area having a luminance value maintained greater than a threshold luminance value for a duration longer than a threshold duration. Additionally, the processor is configured to drive the multiple subpixels to emit light alternatingly in a period of alternate light-emission for displaying the image and drive all adjacent subpixels surrounding any one subpixel that is not emitting light during the period of alternate light-emission to provide luminance rendering to the one subpixel such that the luminance value of the bright area is greater than the threshold luminance value. Optionally, the control terminal can be one selected from a smart phone, a tablet computer, a smart TV, a laptop computer, a desktop computer. The processor disposed therein can be a chip containing integrated circuit.

In another alternative aspect, the present disclosure provides a computer executable storage media. The computer executable storage media stores commands and instructions. When the computer executable storage media is in operation within a computer associated with a display panel, the commands are executed and control signals are generated to drive the display panel to display image according to the instructions described herein.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method for driving a display panel to display image, comprising:

determining multiple subpixels in a bright area of an image to be displayed by the display panel, wherein the bright area is an image display area having a luminance value maintained greater than a threshold luminance value for a duration longer than a threshold duration;

driving the multiple subpixels to emit light alternatingly in a period of alternate light-emission for displaying the image; and driving at least one adjacent subpixel surrounding a first subpixel that is not emitting light during the period of alternate light-emission to provide luminance rendering to the first subpixel such that the luminance value of the bright area is greater than the threshold luminance value;

wherein the driving the multiple subpixels to emit light alternatingly in the period of alternate light-emission comprises:

determining the first subpixel and second subpixels among the multiple subpixels in the bright area corresponding to each period of alternate light-emission; and controlling the first subpixel to not emit light and the second subpixels to emit light with luminance values being increased for providing the luminance rendering to the first subpixel during each period of alternate light-emission;

wherein the second subpixels comprise all subpixels immediate adjacent to the first subpixel;

the first subpixel is a subpixel configured to emit light of a first color;

at least one of the subpixels immediate adjacent to the first subpixel is configured to emit light of a second color; and the first color and the second color are different.

2. The method of claim 1, wherein the first subpixel in the bright area in at least two periods of alternate light-emission are capable of emitting light of a same color.

3. The method of claim 1, wherein at least two first subpixels in the bright area are controlled not to emit light in each period of alternate light-emission.

4. The method of claim 1, wherein the providing the luminance rendering to the first subpixel comprises:

determining an original luminance value of the first subpixel, wherein the original luminance value of the first subpixel is a luminance value when the first subpixel is controlled to emit light according to an original image display data;

controlling the second subpixels to emit light;

adjusting luminance values of the second subpixels based on the original luminance value of the first subpixel, wherein the luminance values of the second subpixels are increased to provide the luminance rendering to the first subpixel when the first subpixel is not emitting light;

wherein a luminance value of the first subpixel after the luminance rendering substantially equals to the original luminance value.

5. The method of claim 4, wherein the adjusting the luminance values of the second subpixels based on the original luminance value of the first subpixel comprises calculating a target luminance value of each second subpixel using a subpixel rendering algorithm based on the original luminance value of the first subpixel and adjusting the luminance value of the each second subpixel based on the target luminance value.

6. The method of claim 1, wherein in any one period of alternate light-emission at least two second subpixels are driven to emit light; and two subsequent periods of alternate light-emission are not associated with any second subpixel in common.

7. The method of claim 6, wherein the multiple subpixels form multiple pixels, each of the multiple pixels comprises at least two of the multiple subpixels;

each of the multiple pixels is associated with at least one period of alternate light-emission; and at least two periods of alternate light-emission are associated with different subpixels of the multiple subpixels in one of the multiple pixels.

8. The method of claim 1, wherein the display panel includes a plurality of subpixels being arranged in SPR form.

9. The method of claim 8, wherein the plurality of subpixels is arranged in an order based on color of emitted light thereof, the order including a pixel of four sequential subpixels capable of emitting red-color, green-color, blue-color, and green-color in a row adapted to a subpixel rendering operation.

10. A driver for controlling image display operation of a display panel comprising at least a processor including a computer readable storage media, the computer readable storage media being configured to store computer-executable instructions, the processor being configured to execute the computer-executable instructions for controlling a display panel for displaying images, the computer-executable instructions comprising:

a first set of instructions for determining multiple subpixels in a bright area of an image to be displayed by the display panel, wherein the bright area is an image display area having a luminance value maintained greater than a threshold luminance value for a duration longer than a threshold duration; and a second set of instructions for driving the multiple subpixels to emit light alternatingly in a period of alternate light-emission for displaying the image and driving at least one adjacent subpixel surrounding a first subpixel that is not emitting light during the period of alternate light-emission to provide luminance rendering to the first subpixel such that the luminance value of the bright area is greater than the threshold luminance value;

wherein the second set of instructions comprises a first subset of instructions for determining the first subpixel and second subpixels among the multiple subpixels in the bright area corresponding to each period of alternate light-emission; and a second subset of instructions for controlling the first subpixel to not emit light and the second subpixels to emit light in each period of alternate light-emission so that luminance values of the second subpixels are increased to provide the luminance rendering to the first subpixel without emitting light;

wherein the second subpixels comprise all subpixels immediate adjacent to the first subpixel;

the first subpixel is a subpixel configured to emit light of a first color;

at least one of the subpixels immediate adjacent to the first subpixel is configured to emit light of a second color; and the first color and the second color are different.

11. The driver of claim 10, wherein the first subpixel in the bright area in at least two periods of alternate light-emission are capable of emitting light of a same color.

12. The driver of claim 10, wherein at least two first subpixels in the bright area are controlled not to emit light in each period of alternate light-emission.

13. The driver of claim 10, wherein the display panel includes a plurality of subpixels being arranged in an order based on color of emitted light thereof, the order including a pixel of four sequential subpixels capable of emitting red-color, green-color, blue-color, and green-color in a row adapted to a subpixel rendering operation.

14. A display apparatus comprising a display panel and a driver of claim 10 including a processor having a computer readable storage media to store computer-executable instructions and to execute the computer-executable instructions for driving the display panel to display images.

15. The driver of claim 10, wherein the second subset of instructions comprising:

a first sub-subset of instructions for determining an original luminance value of the first subpixel, wherein the original luminance value of the first subpixel is a luminance value when the first subpixel is controlled to emit light according to an original image display data;

a second sub-subset of instructions for controlling the second subpixels to emit light; and a third sub-subset of instructions for adjusting luminance values of the second subpixels based on the original luminance value of the first subpixel, wherein the luminance values of the second subpixels are increased to provide the luminance rendering to the first subpixel when the first subpixel is not emitting light;

wherein a luminance value of the first subpixel after the luminance rendering substantially equals to the original luminance value.

16. The driver of claim 15, wherein the third sub-subset of instructions comprises an instruction for calculating a target luminance value of each second subpixel using a subpixel rendering algorithm based on the original luminance value of the first subpixel and adjusting the luminance value of the each second subpixel based on the target luminance value.

17. The driver of claim 10, wherein in any one period of alternate light-emission at least two second subpixels are driven to emit light alternatingly; and two adjacent periods of alternate light-emission are not associated with any second subpixel in common.

18. The driver of claim 17, wherein the multiple subpixels constitute an array of pixels, each of the array of pixels comprises at least two of the multiple subpixels;

each of the array of pixels corresponds to at least one period of alternate light-emission; and at least two periods of alternate light-emission correspond to different subpixels of the multiple subpixels in the each of the array of pixels.

* * * * *